US009203186B2

(12) United States Patent
Shishikura et al.

(10) Patent No.: US 9,203,186 B2
(45) Date of Patent: Dec. 1, 2015

(54) LEVER-TYPE CONNECTOR, WIRE COVER

(71) Applicant: Tyco Electronics Japan G.K., Kanagawa (JP)

(72) Inventors: Seiji Shishikura, Chiba (JP); Kazushige Sakamaki, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 116 days.

(21) Appl. No.: 13/925,112

(22) Filed: Jun. 24, 2013

(65) Prior Publication Data

US 2013/0280935 A1 Oct. 24, 2013

Related U.S. Application Data

(63) Continuation of application No. PCT/JP2011/006239, filed on Nov. 8, 2011.

(30) Foreign Application Priority Data

Dec. 24, 2010 (JP) ..... 2010-288415

(51) Int. Cl.
*H01R 13/44* (2006.01)
*H01R 13/629* (2006.01)
*H01R 13/447* (2006.01)

(52) U.S. Cl.
CPC ..... *H01R 13/62933* (2013.01); *H01R 13/44* (2013.01); *H01R 13/447* (2013.01); *H01R 13/62977* (2013.01); *H01R 13/62955* (2013.01)

(58) Field of Classification Search
USPC ..... 439/147, 153, 157, 347
See application file for complete search history.

(56) References Cited

U.S. PATENT DOCUMENTS

| | | | | |
|---|---|---|---|---|
| 6,039,586 | A | 3/2000 | Kitamura | |
| 7,175,451 | B2 | 2/2007 | Shuey | |
| 8,057,245 | B2 | 11/2011 | Sakamaki et al. | |
| 8,221,142 | B2 | 7/2012 | Sakamaki et al. | |
| 8,439,695 | B2 | 5/2013 | Komiyama | |
| 2008/0188114 | A1 | 8/2008 | Lee et al. | |
| 2009/0317993 | A1* | 12/2009 | Komiyama et al. | 439/157 |
| 2010/0178791 | A1* | 7/2010 | Komiyama et al. | 439/347 |
| 2011/0014804 | A1 | 1/2011 | Sakamaki et al. | |
| 2011/0014805 | A1* | 1/2011 | Sakamaki et al. | 439/153 |

FOREIGN PATENT DOCUMENTS

| | | | |
|---|---|---|---|
| EP | 1037326 | A2 | 9/2000 |
| EP | 1331700 | A2 | 1/2003 |
| JP | 7240254 | A | 9/1995 |
| JP | 09213413 | A | 8/1997 |
| JP | 2008204663 | A1 | 9/2008 |
| WO | 2009001900 | A1 | 12/2008 |

OTHER PUBLICATIONS

European Search Report, Application No. 11850760.7, dated Jun. 10, 2014, 7 pages.
Chinese OA issued in co-pending application CN201180062373.6, dated Feb. 27, 2015, 7 pages.
Bibliographic date for JPH07240254, 2 pages dated Sep. 12, 1995; also published as JP3299624(B2).

* cited by examiner

*Primary Examiner* — Abdullah Riyami
*Assistant Examiner* — Harshad Patel
(74) *Attorney, Agent, or Firm* — Barley Snyder

(57) ABSTRACT

A lever-type connector is provided, with the lever-type connector having a housing containing a contact, a wire cover attachable to a rear side of the housing, and a lever rotatably attached to the housing. The wire cover includes a guide with a cover guide surface extending toward the housing and a stopper surface extending from an end of the wire cover and intersecting the cover guide surface. The lever includes a pair of side plates positioned around the wire cover, each of the pair of side plates having a guide protrusion positioned along an end thereof and projecting toward the housing and engaging the guide when the lever is made at a predetermined angle once the lever is attached to the housing.

15 Claims, 7 Drawing Sheets

LEVER-TYPE CONNECTOR, WIRE COVER

CROSS-REFERENCE TO RELATED APPLICATIONS

This application is a continuation of PCT International Application No. PCT/JP2011/006239, filed Nov. 8, 2011, which claims priority under 35 U.S.C. §119 to Japanese Patent Application No. JP 2010-288415, filed Dec. 24, 2010.

FIELD OF THE INVENTION

The present invention relates to a connector and in particular to a lever-type connector to unite and release from a mating connector by rotation of a lever.

BACKGROUND

In recent years, electric connectors having numerous terminals are being used in the field of automobiles and the like, and are continually become more and more advanced. With an electric connector having numerous terminals, a large force is necessary to mate together connectors and release the connection. Therefore, in the field of automobiles and the like, a lever-type connector to mate with and release from a mating connector utilizing effect of boosting by a lever is used. For example, Japanese Patent Laid-Open No. 2009-245608 and Japanese Patent Laid-Open No. 2009-245609 discloses known lever-type connectors to mate with and release from a mating connector.

As shown in FIGS. 6 and 7, a lever 2 of a known lever-type connector 1 has a pair of side plates 2*a* and a connecting part 2*b* for connecting both the side plates to each other, and is formed into a U shape. Also, on each of the inner surfaces in the tip end portions of both the side plates 2*a*, a lever moving projection 4 is provided for attaching the lever 2 to a housing 3 of the lever-type connector 1.

In the process for assembling the lever-type connector 1, when the lever 2 is attached to the housing 3, a worker needs to manually insert each of the lever moving projections 4 formed on the lever 2 into a projection receiving portion 6 formed in a lever bearing section 5. The configuration is made such that, at this time, when the lever 2 is tilted at a predetermined angle with respect to the housing 3, the lever moving projections 4 can be inserted into the projection receiving portion 6. Therefore, the worker needs to adjust the tilt angle of the lever 2 with respect to the housing 3 so that the lever moving projections 4 coincide with the projection receiving portion 6, this work being troublesome.

Further, as shown in FIG. 7B, a part 2*c* of the lever 2 interferes with a wire cover 7 that attaches to the housing 3. As a result, the lever 2 cannot be assembled in certain conditions such that the lever moving projections 4 coincide with the projection receiving portion 6. Further, if an attempt is made to forcefully insert the lever moving projections 4 of the lever 2 into the projection receiving portion 6, the lever 2 may be damaged, or the projection receiving portion 6 may be deformed.

SUMMARY

Accordingly, the present invention has been made in view of the above-described problems, and accordingly an object thereof is to provide a lever-type connector according to the invention.

The lever-type connector having a housing containing a contact, a wire cover attachable to a rear side of the housing, and a lever rotatably attached to the housing. The wire cover includes a guide with a cover guide surface extending toward the housing and a stopper surface extending from an end of the wire cover and intersecting the cover guide surface. The lever includes a pair of side plates positioned around the wire cover, each of the pair of side plates having a guide protrusion positioned along an end thereof and projecting toward the housing and engaging the guide when the lever is made at a predetermined angle once the lever is attached to the housing.

BRIEF DESCRIPTION OF THE DRAWING(S)

The invention is described in more detail in the following with reference to the embodiments shown in the drawings. Similar or corresponding details in the Figures are provided with the same reference numerals. The invention will be described in detail with reference to the following figures of which:

DETAILED DESCRIPTION OF THE EMBODIMENT(S)

The present invention will now be described in detail based on an exemplary embodiment of the invention, shown in the accompanying drawings.

Figure 1A:
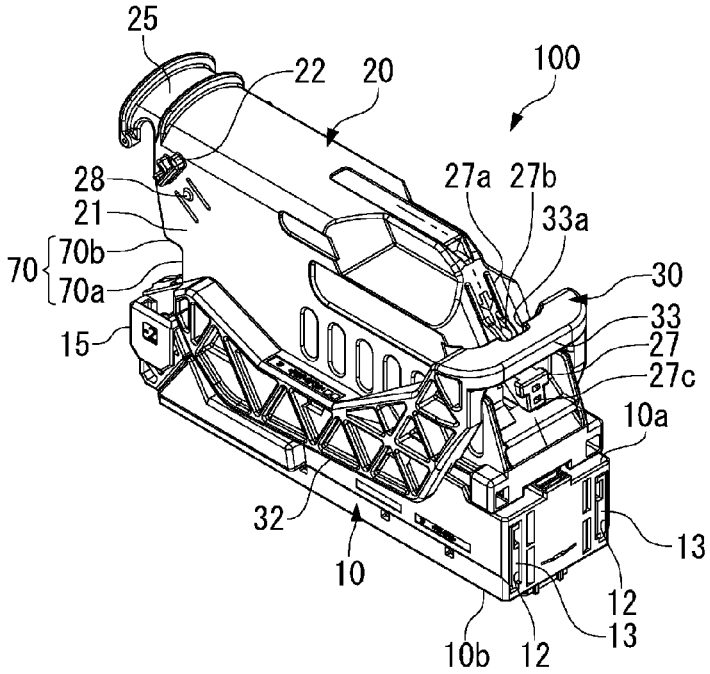
FIG. 1A is a perspective view of a lever-type connector according to the invention, showing a lever tilted downward.
Figure 1B:
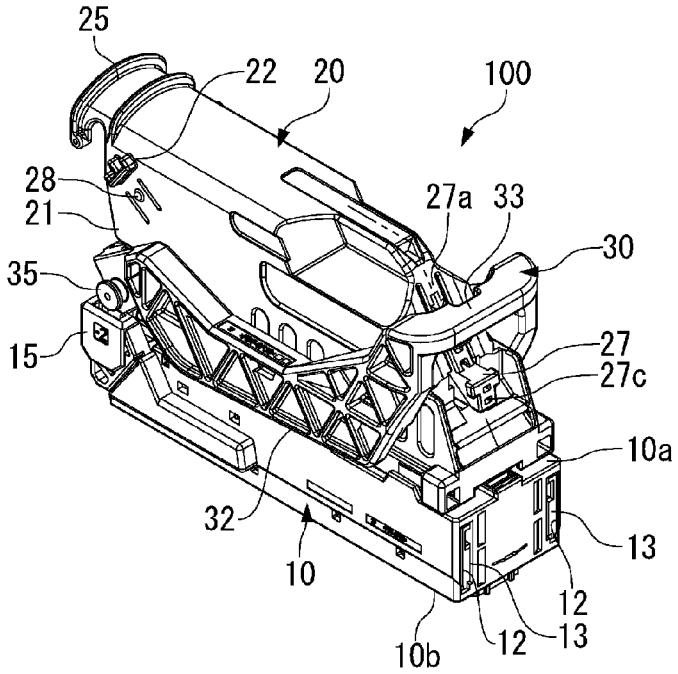
FIG. 1B is a perspective view of the lever-type connector according to the invention, the lever assembled to a housing of the lever-type connector.

As shown in FIGS. 1A and 1B, a lever-type connector 100 according to the invention includes a housing 10 receiving a plurality of contacts (not shown), a wire cover 20 mounted to one surface side of the housing 10, and a lever 30 attached to the housing 10.

Figure 2A:
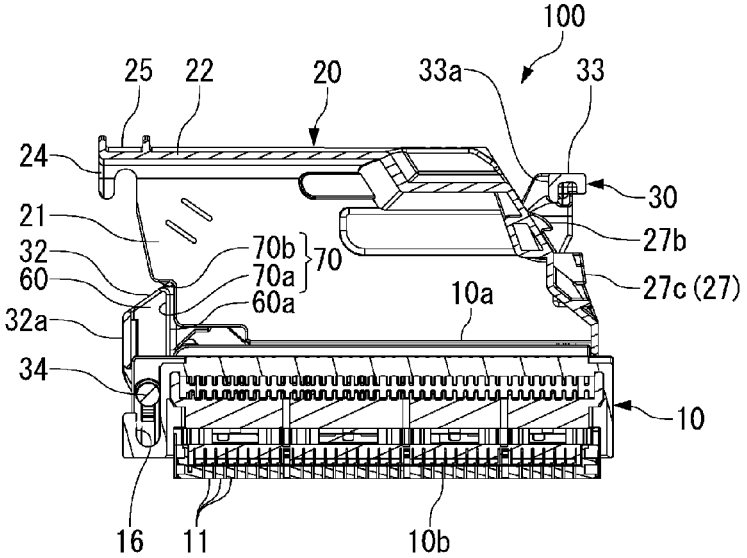
FIG. 2A is a sectional view of the lever-type connector according to the invention, showing the lever assembled to the housing.
Figure 2B:
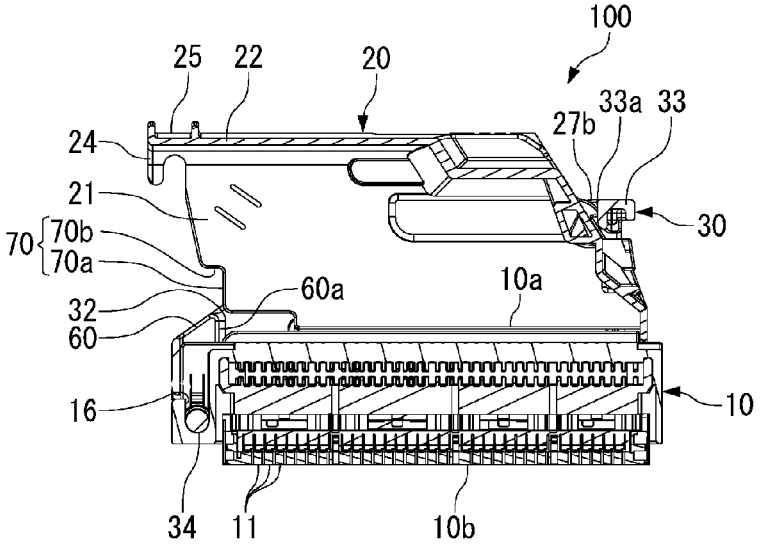
FIG. 2B is a sectional view of the lever-type connector according to the invention, showing the lever tiled downward.

As shown in FIGS. 2A and 2B, the housing 10 has a plurality of contact receiving passageways 11 penetrating in a direction such that a facing surface 10*a* facing to the wire cover 20 and an opposite surface 10*b* thereof are connected to each other. The facing surface 10*a* and the opposite surface 10*b* each have a rectangular shape that is long in one direction.

As shown in FIGS. 1A and 1B, the housing 10 is provided with slider receiving passageways 12, which extend along a longitudinal length of the facing surface 10*a*, on both sides of the facing surface 10*a*. In each of the slider receiving passageways 12, a slider 13 is receivable so as to be movable in the direction in which the slider receiving passageway 12 continues.

In an exemplary embodiment, the slider 13 is a flat plate shape member having a plurality of cam grooves (not shown) that draw in and push out cam pins (not shown) provided on the mating connector.

Figure 3A:
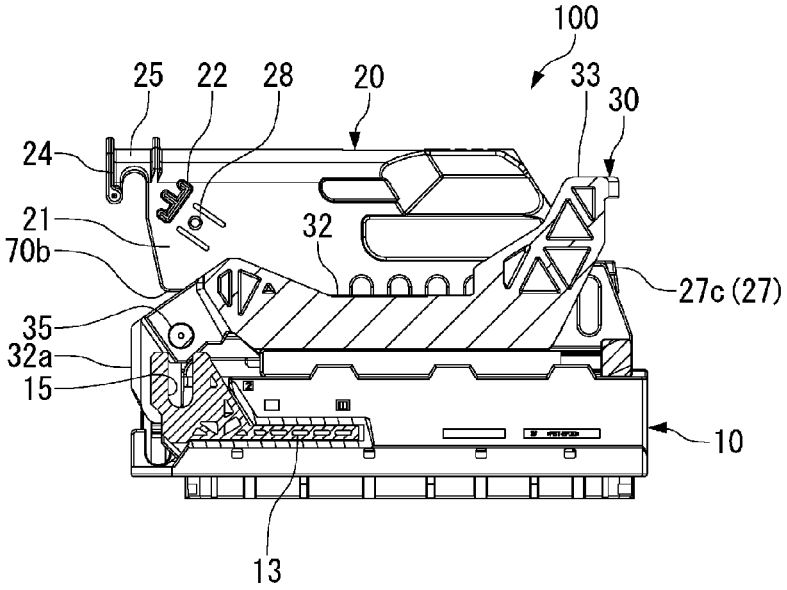
FIG. 3A is a sectional view of the lever-type connector according to the invention, showing a slider moving projection portion of the lever.
Figure 3B:
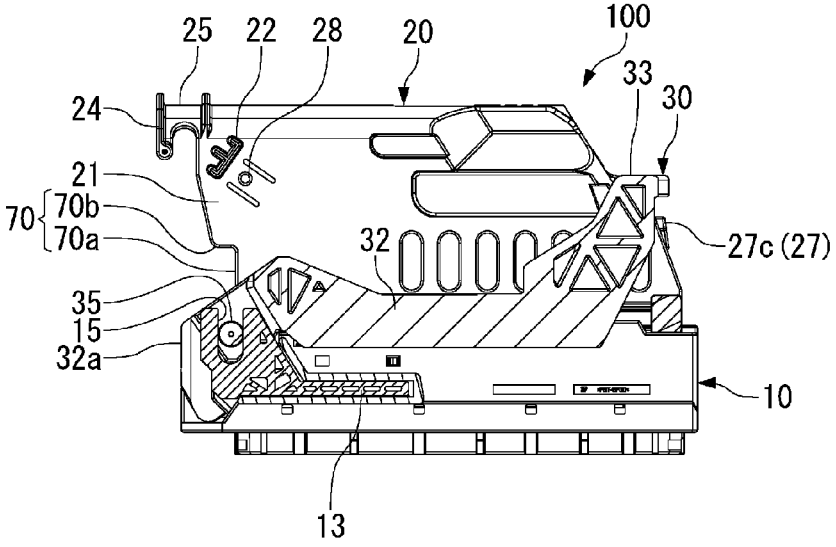
FIG. 3B is another sectional view of the lever-type connector according to the invention, showing the slider moving projection portion of the lever.

Also, as shown in FIGS. 3A and 3B, a slider projection receiving portion 15 is disposed at one end portion of the slider 13, so that a slider moving projection 35, which is described later, of the lever 30 is supported and is rotatable. The slider projection receiving portion 15 is positioned such that it is be exposed to the outside from the slider receiving passageway 12 when the slider 13 is received in the slider receiving passageway 12.

Also, as shown in FIGS. 2A and 2B, a housing projection receiving portion 16 is disposed at one end portion of the facing surface 10*a* of the housing 10, in which a lever moving projection 34, which will be described later, of the lever 30 is supported and be turnable.

Figure 4A:
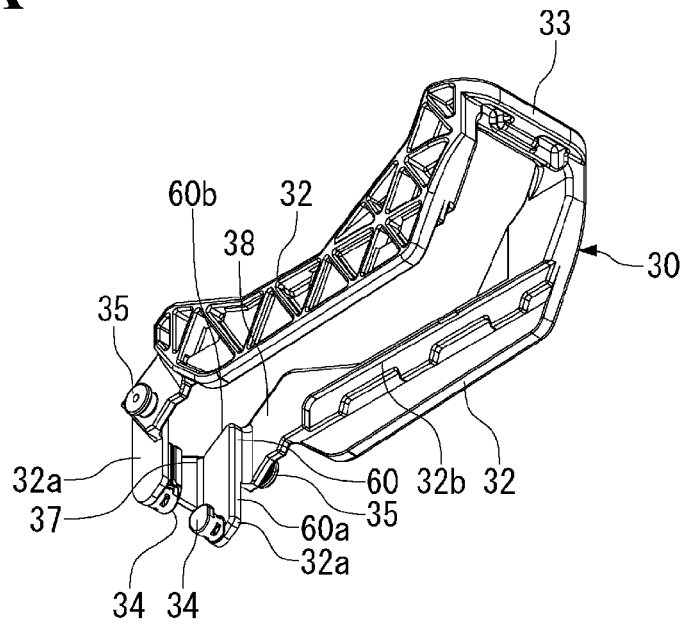
FIG. 4A is a bottom perspective view of the lever of the lever-type connector according to the invention.
Figure 4B:
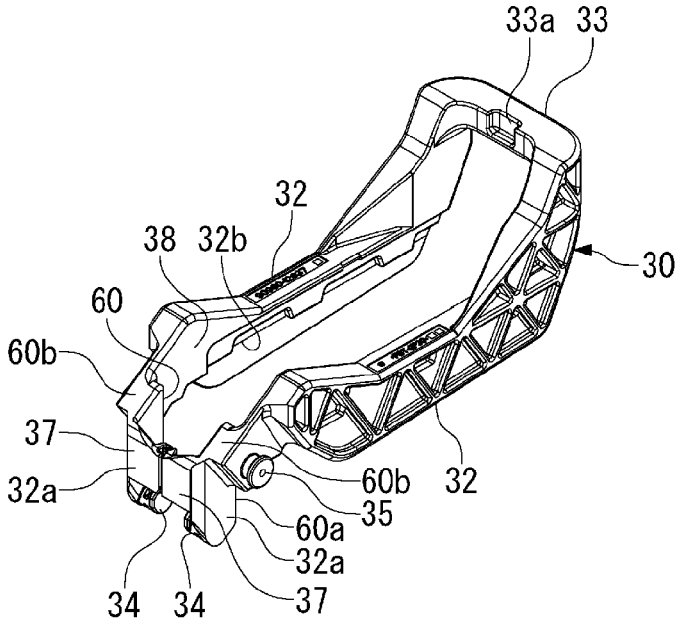
FIG. 4B is a top perspective view of the lever of the lever-type connector according to the invention.

As shown in FIGS. 4A and 4B, the lever 30 has a pair of side plates 32 extending in parallel with each other and a connecting part 33 for connecting the other ends of both the side plates 32 to each other to form a U shape.

A joining section 32*a* is positioned at one end of each of both the side plates 32, and extends at a fixed angle with respect to the direction to which both the side plate 32 extend. In the shown embodiment, each joining section 32*a* extends substantially orthogonal with respect to the direction to which both the side plate 32 extend.

Each slider moving projection 35 is positioned on the outer surface of each joining section 32*a*. The slider moving projection 35, which is fitted in the slider projection receiving portion 15 in the slider 13, projects toward the outside, while the lever moving projection 34 are positioned on the inner surface thereof and project toward the inside and is fittable with the housing projection receiving portion 16 of the housing 10.

Also, on the inner surfaces of one end portions of both the side plates 32, a connecting plate 37 extending toward the inside is provided.

Further, a planar section 38 is formed on the inner surface on one end side of each of both the side plates 32.

A guide protrusion 60 is formed on the inner surface on one end side of the side plate 32, in a region facing the lever moving projection 34 and the slider moving projection 35. The guide protrusion 60 projects toward the inside with respect to the planar section 38. In the shown embodiment, the guide protrusion 60 has a lever cover guide surface 60*a*, which is planar shaped in the shown embodiment, and intersects the planar section 38 at a right angle. Also, a backup surface 60*b* is formed adjacent to the lever cover guide surface 60*a*, and intersect the lever cover guide surface 60*a* at a right angle. The backup surface 60*b* extends at an acute angle with respect to the lever cover guide surface 60*a*.

The connecting part 33 includes a depression 33*a* to which a locking piece 27*b* of a lock 27, described later, of the wire cover 20 is locked.

Figure 5:
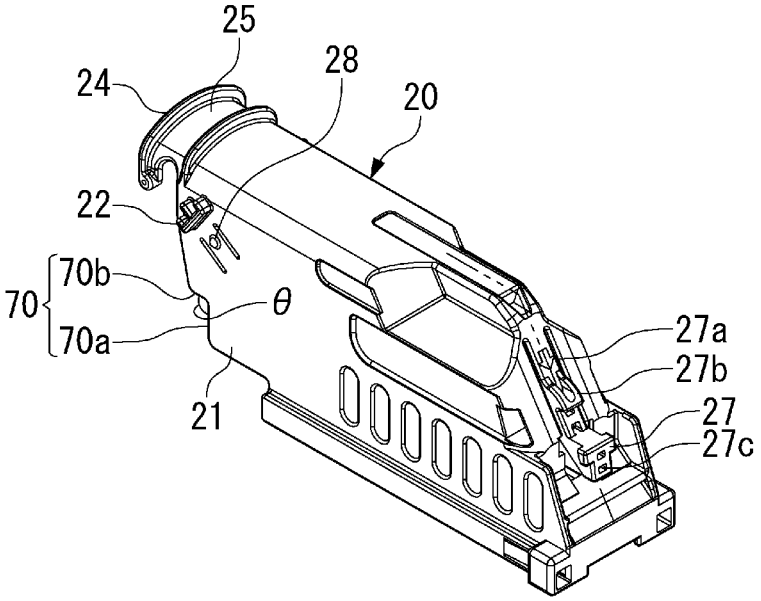
FIG. 5 is a perspective view of a wire cover of the lever-type connector according to the invention.
Figure 6:
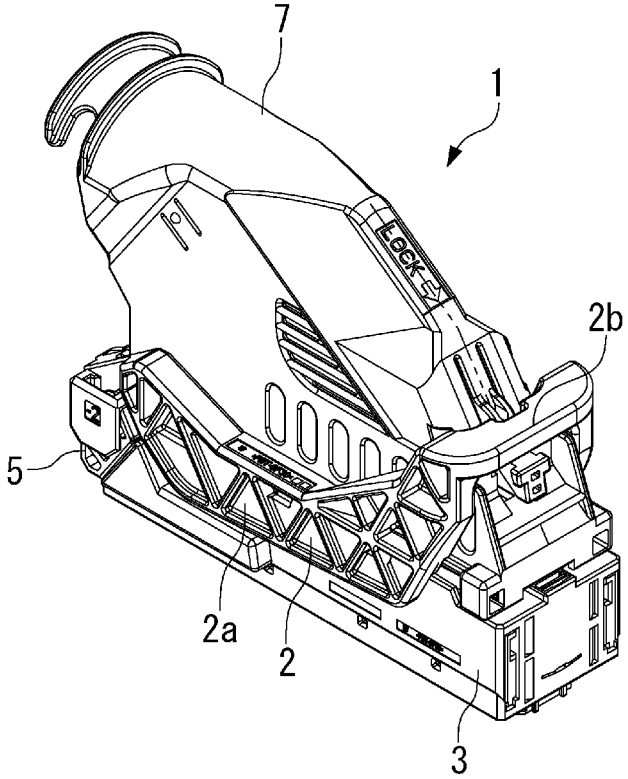
FIG. 6 PRIOR ART
FIG. 6 is a perspective view of a known lever-type connector.
Figure 7A:
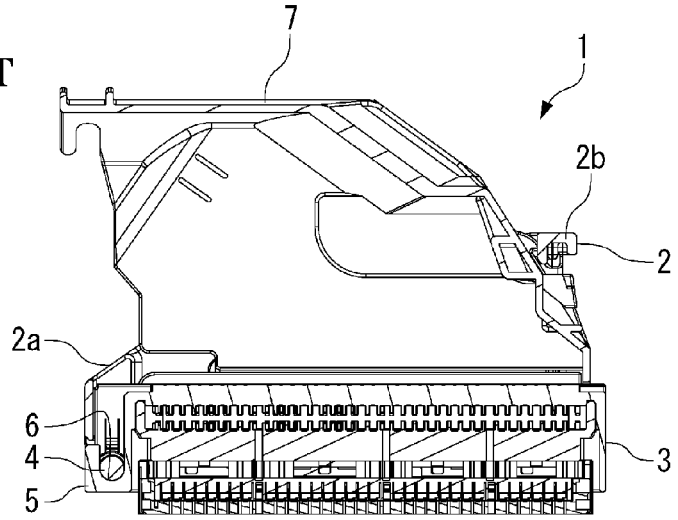
FIG. 7A PRIOR ART
FIG. 7A is a sectional view of the known lever-type connector, showing a lever assembled to a housing of the known lever-type connector.
Figure 7B:
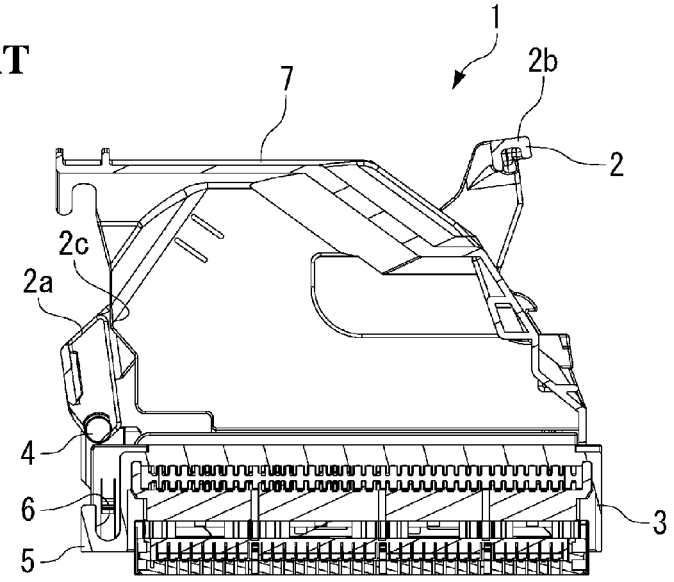
FIG. 7B PRIOR ART
FIG. 7B is a perspective view of the known lever-type connector, showing the lever tilted downward.

As shown in FIG. 5, the wire cover 20 has a body 21 that covers a plurality of electric wires (not shown) connected to the contacts received in the housing 10 and receives the electric wires therein, and stoppers 22 provided on both sides of the body 21. The thickness of the body 21 is formed so as to be smaller than the space between both the side plates 32 of the lever 30. On the other hand, the stoppers 22 are formed so as to be larger than the space between both the side plates 32 of the lever 30, thereby regulating the rotation angle of which the lever 30 is pulled up.

In the shown embodiment, a wire outlet 24 is positioned on one side of the stoppers 22, which that allows the electric wires connected to the contacts received in the housing 10 to be pulled out of the wire cover 20. Also, a hood part 25 is positioned around the wire outlet 24 and projects toward one side of the wire cover 20.

A guide 70 is positioned along one end portion of the body 21. The guide 70 regulates the angle of the lever 30 when the slider moving projections 35 and the lever moving projections 34 are fitted in the slider projection receiving portions 15 and the housing projection receiving portions 16, respectively. The guide 70 has a cover guide surface 70*a* (i.e. straight line-shaped) and a stopper surface 70*b*. The cover guide surface 70*a* extends in the direction in which the slider moving projections 35 and the lever moving projections 34 are inserted into the slider projection receiving portions 15 and the housing projection receiving portions 16, respectively. The stopper surface 70*b* is continuous with the end portion. The stopper surface 70*b* in the shown embodiment intersects the cover guide surface 70*a* at right angles. However, one skilled the art should appreciate that the stopper surface 70*b* could intersect the cover guide surface 70*a* at an acute crossing or other angles θ.

As shown, the lock 27 is provided on the rear surface of the body 21. The lock 27 prevents the lever 30, which has been rotated to a final position on the front side, from rotating toward the rear side. The lock 27 is formed in a cantilever plate-spring form and extends from the rear side toward the front side of the connecting part 33 of the lever 30 when positioned at the final position on the front side. The lock 27 has a plate spring 27*a*, and a locking piece 27*b* and a release projection portion 27*c* provided on the outer surface of the plate spring 27*a*. The plate spring 27*a* extends from the rear toward the front of the connecting part 33 of the lever 30 positioned at the final position on the front side. The locking piece 27*b* is provided for latching onto the depression 33*a* of the connecting part 33 when positioned at the final position on the front side. The release projection portion 27*c* is provided so as to be positioned on the front side of the connecting part 33 of the lever 30 when positioned at the final position on the front side. The release projection portion 27*c* releases the locking of the locking piece 27*b* to the depression 33*a* in the connecting part 33 due to the elastic deformation of the plate spring 27*a* caused by the pressing thereof.

Lock projection portions 28, which prevent the lever 30 that has been rotated until the final position on the front side from rotating toward the rear, are provided on the top surface and the bottom surface of the body 21. Each of the lock projection portions 28 is provided for latching onto the sides of the notches 32*b* of each of the side plates 32 of the lever 30 positioned at the final position on the rear side.

Next, a method for assembling the lever-type connector 100 is explained.

When the lever-type connector 100 is assembled, first, the contacts connected to the electric wires are positioned in the plurality of contact receiving passageways 11 in the housing 10. Also, the sliders 13 are inserted into both the slider receiving passageways 12 in the housing 10.

Subsequently, the wire cover 20 is mounted to the housing 10 in which the plurality of contacts has been received. Once the wire cover 20 is mounted to the housing 10, the electric wires, connected to the plurality of contacts, are bundled and pulled out to the outside through the wire outlet 24.

Next, the lever 30 is attached to the housing 10 to which the wire cover 20 has been mounted. Once the lever 30 is attached to the housing 10, the lever 30 must be arranged such that both the side plates 32 are laid across the back surface side of the wire cover 20 and the wire cover 20 is held between both the side plates 32.

Therefore, when the lever 30 is attached to the housing 10, first, the tip end portions of both the side plates 32 are manually expanded, and the wire cover 20 is inserted between the tip ends of the connecting plates 37 of both the side plates 32.

When the lever 30 is pushed in further, the tip ends of the connecting plates 37 of both the side plates 32 go beyond the body 21 of the wire cover 20. Then, the deformation of the connecting part 33 of the lever 30 is released, and the lever 30 is arranged on the wire cover 20 such that the wire cover 20 is held between both the side plates 32.

The lever moving projections 34 on both the side plates 32 of the lever 30 are fitted in the housing projection receiving portions 16 in the housing 10, and the slider moving projections 35 on both the side plates 32 of the lever 30 are fitted in the slider projection receiving portions 15 in the sliders 13.

At this time, as shown in FIG. 2A, the tilt angle of the lever 30 is determined by pressing the guide protrusions 60 of the lever 30 against the guide 70. More specifically, by butting the lever cover guide surfaces 60*a* of the guide protrusions 60 against the cover guide surface 70*a* of the guide 70, the tilt angle of the lever 30 with respect to the wire cover 20 is determined. When the lever 30 is slid along the cover guide surface 70*a* in this state, the slider moving projections 35 and the lever moving projections 34 can be fitted in the slider projection receiving portions 15 and the housing projection receiving portions 16, respectively.

In this manner, the lever 30 is attached to the wire cover 20, and the assembly of the lever-type connector 100 is completed. Accordingly, the lever 30 can be fitted in the slider projection receiving portions 15 and the housing projection receiving portions 16 easily and reliably. As the result, the assembly of the lever-type connector 100 is improved.

Also, at this time, since the guide 70 is formed with the stopper surface 70*b*, if the lever 30 is going to move away from the slider moving projections 35 and the lever moving projections 34 fitted in the slider projection receiving portions 15 and the housing projection receiving portions 16, respectively, the guide protrusions 60 collide with the stopper surface 70*b*. Further, since the stopper surface 70*b* is positioned orthogonal to the cover guide surface 70*a*, the guide protrusions 60 are less liable to come off the guide 70.

In the above-described embodiment, the guide 70 is substantially L shaped, consisting of the cover guide surface 70*a* and the stopper surface 70*b* positioned orthogonal to each other. However, the present invention is not limited to this configuration. The stopper surface 70*b* may be formed so as to make an acute angle with the cover guide surface 70*a*, or the guide 70 may be made such as to substantially have a J shape or the like shape by providing an extension portion, which extends to the slider projection receiving portions 15 and the housing projection receiving portions 16 side, in the tip end portion of the stopper surface 70*b*, thereby more reliably preventing the guide protrusions 60 from coming off the guide 70 when the lever 30 is mounted.

Also, in the above-described embodiment, the configuration of the lever-type connector 100 has been explained. As far as the guide protrusions 60 and the guide 70 are provided, the housing 10, the wire cover 20, and the lever 30 may have any configuration.

Besides, the configurations described in the above embodiment can be selected, or can be changed as appropriate to any other configuration without departing from the spirit and scope of the present invention.

What is claimed is:

1. A lever-type connector comprising:

a housing containing a contact;

a wire cover attachable to a rear side of the housing and having a guide with a cover guide surface extending toward the housing and a stopper surface extending from an end of the wire cover and intersecting the cover guide surface;

a lever rotatably attached to the housing and having a pair of side plates positioned around the wire cover, each of the pair of side plates having a guide protrusion positioned along an end thereof and projecting toward the housing and engaging the guide when the lever is positioned at a predetermined angle once the lever is attached to the housing;

a connecting part connecting the pair of side plates to each other;

a depression disposed on the connecting part; and, a lock positioned on a rear surface of the wire cover and including a plate spring, a locking piece, and a release projection portion positioned on an outer surface of the plate spring, the locking piece positioned for latching onto the depression.

2. The lever-type connector according to claim 1, wherein the stopper surface is positioned orthogonal to the cover guide surface.

3. The lever-type connector according to claim 1, further comprising a slider receiving slot positioned on an inner surface of the housing.

4. The lever-type connector according to claim 3, further comprising a slider received in the slider receiving slot so as to move freely.

5. The lever-type connector according to claim 4, wherein the lever includes a slider moving projection which joins to a projection receiving portion of the slider, the slider moving projection protrudes outward from an outer surface of an end of the pair of side plates.

6. The lever-type connector according to claim 5, further comprising a joining section positioned at an opposite end of the pair of side plates with respect to the connecting part.

7. The lever-type connector according to claim 1, wherein the wire cover includes a body and a wire outlet positioned at one end of the body and from which a plurality of electric wires are pulled out from the interior of the body to the outside.

8. The lever-type connector according to claim 7, wherein the wire cover further includes a hood part projecting from a periphery of the wire outlet to regulate a pullout direction of the plurality of electric wires.

9. The lever-type connector according to claim 1, wherein each guide protrusion is disposed on an inner surface of each of the pair of side plates.

10. The lever-type connector according to claim 9, wherein each guide protrusion projects toward an inside with respect to a planar section of each of the pair of side plates.

11. The lever-type connector according to claim 10, wherein each guide protrusion includes a lever cover guide surface having planar shape and intersecting the planar section at a right angle.

12. The lever-type connector according to claim 11, wherein each guide protrusion further includes a backup surface formed adjacent to and intersecting the planar section at a right angle.

13. The lever-type connector according to claim 12, wherein the backup surface extends away from the planar section at an acute angle with respect to the lever cover guide surface.

14. A lever-type connector comprising:

a housing containing a contact;

a wire cover attachable to a rear side of the housing and having a guide with a cover guide surface extending toward the housing and a stopper surface extending from an end of the wire cover and intersecting the cover guide surface; and a lever rotatably attached to the housing and having a pair of side plates positioned around the wire cover, each of the pair of side plates having a planar section, a guide protrusion positioned along an end of the side plate and projecting toward the housing and engaging the guide when the lever is positioned at a predetermined angle once the lever is attached to the housing, each guide protrusion having a planar lever cover guide surface intersecting the planar section at a right angle, and a backup surface adjacent to and intersecting the planar section at a right angle, and extending away from the planar section at an acute angle with respect to the lever cover guide surface.

15. A lever-type connector comprising:

a housing containing a contact;

a wire cover attachable to a rear side of the housing and having a guide with a cover guide surface extending toward the housing and a stopper surface extending from an end of the wire cover and intersecting the cover guide surface; and a lever rotatably attached to the housing and having a pair of side plates positioned around the wire cover, each of the pair of side plates having a guide protrusion positioned along an inner surface at an end thereof and projecting toward the housing and toward an inside with respect to a planar section of each of the pair of side plates and engaging the guide when the lever is positioned at a predetermined angle once the lever is attached to the housing;

a lever cover guide surface disposed on each guide protrusion and having a planar shape and intersecting the planar section at a right angle; and, a backup surface disposed on each guide protrusion and formed adjacent to and intersecting the planar section at a right angle, the backup surface extending away from the planar section at an acute angle with respect to the lever cover guide surface.

* * * * *